United States Patent [19]

Sterrenberg

[11] 4,318,622

[45] Mar. 9, 1982

[54] APPARATUS AND METHOD FOR UTILIZING HAND-HELD POWER TOOL FOR SHAKING PAINT CONTAINERS AND THE LIKE

[76] Inventor: John W. Sterrenberg, 8350 E. McKellips Rd., #146, Scottsdale, Ariz. 85257

[21] Appl. No.: 174,172

[22] Filed: Jul. 31, 1980

[51] Int. Cl.[3] ..... B01F 11/00

[52] U.S. Cl. ..... 366/110; 366/111; 366/128; 366/130; 366/208

[58] Field of Search ..... 366/110, 111, 114, 129, 366/130, 128, 197, 208

[56] References Cited

U.S. PATENT DOCUMENTS 2,846,201 8/1958 Mermelstein ..... 366/110

3,330,537 7/1967 Wason ..... 366/114

*Primary Examiner*—Robert W. Jenkins

*Attorney, Agent, or Firm*—Cahill, Sutton & Thomas

[57] ABSTRACT

An apparatus for shaking an aerosol spray paint container includes a base having a cradle for receiving the container and a pair of clamps for removably securing the container within the cradle. The base is releasably secured to the movable driven member of a hand-held power tool for shaking the container. If a hand-held power sander is utilized to shake the container, then the base of the shaking apparatus is clamped to the vibrating sanding plate of the sander. If a drill or other hand-held power tool having a rotatable chuck is utilized to shake the container, then the shaking apparatus includes a first drive shaft rotatably mounted to the base; a second drive shaft is concentrically mounted to the first drive shaft and is engaged by the rotatable chuck of the power tool for causing the base to rapidly oscillate and vibrate.

6 Claims, 11 Drawing Figures

APPARATUS AND METHOD FOR UTILIZING HAND-HELD POWER TOOL FOR SHAKING PAINT CONTAINERS AND THE LIKE

BACKGROUND OF THE INVENTION

1. Field of the Invention

The present invention relates generally to a method and an apparatus for shaking paint containers and the like, and more particularly, to an apparatus and a method for shaking a container utilizing a hand-held power tool.

2. Description of the Prior Art

As is well known, paint must be thoroughly mixed and agitated prior to use in order to ensure that pigment which normally settles out of the liquid carrier is returned into suspension therewith. Apparatus is known in the art for shaking relatively large containers of paint, and such apparatus is typically installed within paint stores for shaking paint containers at the time they are purchased by the customer. Apparatus has also been provided for mixing or stirring paint wherein a shaft having a plurality of blades at its lower end is inserted within an opened paint container and rotated for stirring the paint.

The above described prior art shaking and mixing apparatus may not be utilized in conjunction with aerosol spray paint containers or relatively small sized liquid paint containers. For containers of this type, the user must typically shake the container manually prior to use. However, it is often difficult to return settled paint pigment into suspension by manually shaking the container, particularly when the paint is being used long after it was manufactured and packaged within the container. Accordingly, such containers of paint must typically be manually shaken for relatively long periods of time to achieve proper mixing. Thorough mixing is particularly important with aerosol spray paint containers since the presence of settled pigment may result in the spray nozzle becoming clogged or delivering the spray intermittently.

Accordingly, it is an object of the present invention to provide an apparatus and a method for quickly and thoroughly shaking aerosol spray paint containers and relatively small liquid paint containers to ensure that settled paint pigments are put back into suspension immediately before the paint is to be used.

It is another object of the present invention to provide an apparatus and a method for shaking aerosol spray paint containers and small liquid paint containers wherein the apparatus and method can be utilized in conjunction with hand-held power tools of the type often found around the home.

These and other objects of the present invention will become apparent to those skilled in the art as the description thereof proceeds.

SUMMARY OF THE INVENTION

Briefly, and in accordance with one embodiment thereof, the present invention relates to an apparatus utilized in conjunction with a hand-held power tool for shaking a container, the power tool being of the type which includes a driven member that is moved when the power tool is operated. The apparatus includes a base to which the container to be shaken is removably secured by a clamp or similar means. The present invention also provides a mechanism for engaging the base with the movable driven member of the power tool in order to vibrate the base when the power tool is operated.

In one form of the present invention, the base is removably secured to the vibrating sanding plate of a hand-held power sander for vibrating the base and the container secured thereto when the sander is operated. In another form of the present invention, a first drive shaft is rotatably secured to the base while a second drive shaft is eccentrically mounted to the first drive shaft. The second drive shaft is engaged by the rotatable chuck of a drill or other hand-held power tool, and rotation of the chuck results in oscillatory vibrational movement of the base and the container secured thereto.

DESCRIPTION OF THE PREFERRED EMBODIMENTS

Figure 1:
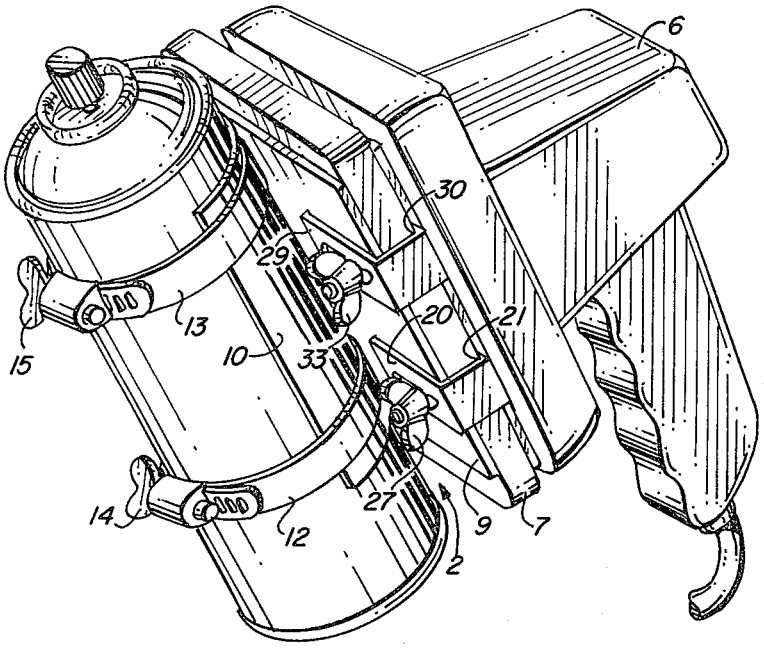
FIG. 1 is a perspective view of an apparatus for shaking a paint container utilized in conjunction with a hand-held power sander according to the teachings of the present invention.
Figure 2:
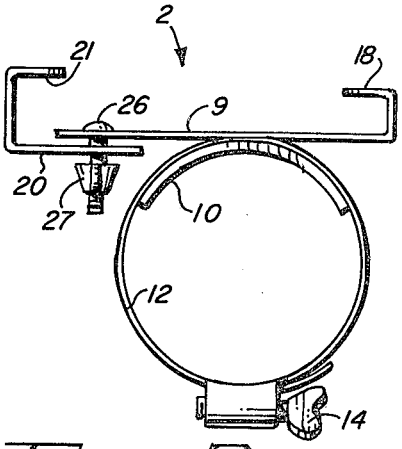
FIG. 2 is a back view of the shaking apparatus shown in FIG. 1.
Figure 3:
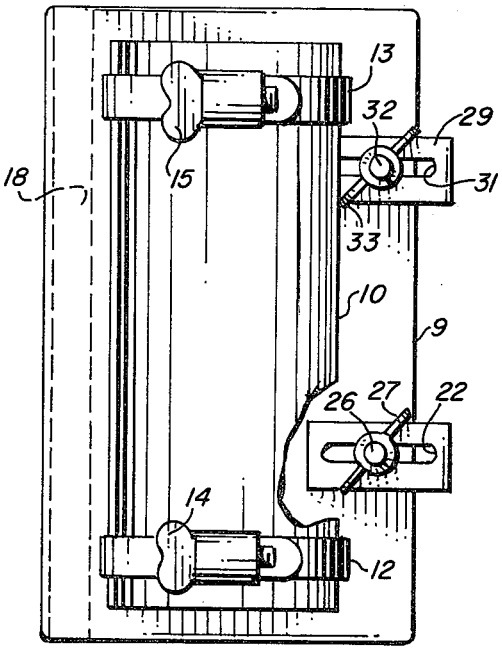
FIG. 3 is a bottom view of the shaking apparatus shown in FIG. 1.
Figure 4:
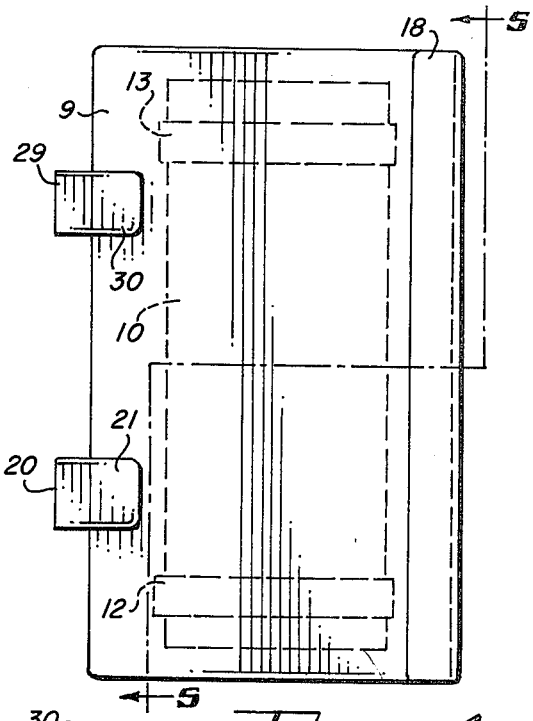
FIG. 4 is a top view of the shaking apparatus shown in FIG. 1.
Figure 5:
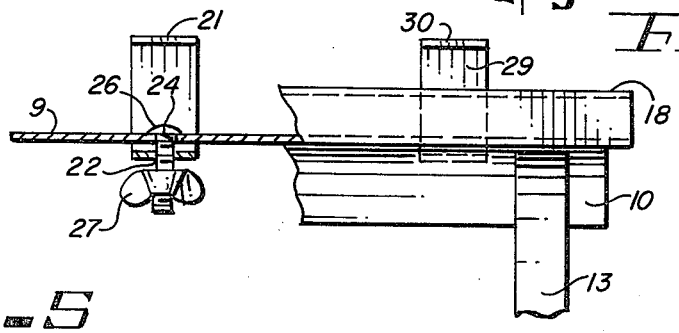
FIG. 5 is a cross-sectional side view taken through dashed lines 5—5 as shown in FIG. 4.

In FIG. 1, a shaking apparatus, designated generally by reference numeral 2, is shown for shaking an aerosol spray paint container 4. Shaking apparatus 2 is utilized in conjunction with an electric powered hand-held sander 6 and is secured to the vibrating sanding plate 7 thereof. Sander 4 may be either of the type which vibrates in a straight-line fashion or of the type which vibrates in an orbital fashion. Vibrating sanders of the types now commercially available typically vibrate at a frequency between 4,000 and 12,000 cycles or orbits per minute and are therefore well adapted for rapidly shaking paint container 4 when utilized in conjunction with the shaking apparatus of the present invention.

Referring to FIGS. 1-5, shaking apparatus 2 includes a base 9 having a curved cradle or saddle 10 attached thereto for receiving paint container 4. Adjustable band clamps 12 and 13 extend around cradle 10 at opposite ends thereof for removably clamping paint container 4 within cradle 10. Band clamps 12 and 13 are provided with thumbscrews 14 and 15, respectively, for either tightening or loosening band clamps 12 and 13. Those skilled in the art will realize that other types of clamping mechanisms may also be utilized to retain paint container 4 against cradle 10. For example, band clamps utilizing a snap-type clasp (described in further detail below with reference to FIG. 7) may be used in place of band clamps 12 and 13.

Base 9 includes a lipped edge portion 18 for extending over and engaging a first edge of vibrating sanding plate 7. A first clamping member 20 having a lipped edge portion 21 is attached to base 9 opposite lipped portion 18 thereof. A slot 22 is provided in first clamping member 20, and a hole 24 (see FIG. 5) is provided within base 9 adjacent first clamping member 20. A bolt 26 is extended through hole 24 and through slot 22, and a wing nut 27 is threaded over the end of bolt 26 for fastening first clamping member 20 in a predetermined position relative to base 9. Similarly, a second clamping member 29 having a lipped edge portion 30 is attached to base 9 opposite the lipped edge portion 18 thereof. A slot 31 is formed in second clamping member 29, and a hole (not shown) is formed within base 9 adjacent second clamping member 29. Bolt 32 and wing nut 33 serve to fasten second clamping member 29. in a predetermined position with respect to base 9.

The width of vibrating sanding plate 7 for conventional power sanders typically falls within the range of three and one-half inches to four and one-half inches. Accordingly, slots 22 and 31 within first and second clamping members 20 and 29, respectively, each exceed one inch in length to allow for sufficient variation in the distance between lipped edge portion 18 of base 9 and the lipped edge portions 21 and 30 for releasably securing base 9 to any of the various types of power sanders commercially available.

The vibrating sanding plate for the majority of power sanders presently available are eight inches or greater in length. However, some power sanders presently available, for example the power sander sold by Rockwell International Corporation under the registered trademark "SPEEDBLOC", have vibrating sanding plates as small as four inches in length. Accordingly, first and second clamping members 20 and 29 are preferably spaced approximately four inches apart for enabling the shaking apparatus to be utilized in conjunction with virtually all power sanders presently available.

During actual operation, the shaking apparatus illustrated in FIGS. 1–5 is clamped to the vibrating sanding plate 7 of sander 6 by inserting lipped edge portion 18 of base 9 over one edge of vibrating sanding plate 7 and inserting lipped edge portions 21 and 30 of first and second clamping member 20 and 29, respectively, over the opposite edge of vibrating sanding plate 7. Wing nuts 27 and 33 are tightened for securing base 9 to vibrating sanding plate 7. Thumbscrews 14 and 15 are rotated for expanding band clamps 12 and 13, and paint container 4 is then inserted within cradle 10. Thumbscrews 14 and 15 are then rotated to tighten band clamps 12 and 13 for securing paint container 4 within cradle 10. Power sander 6 is then operated for several minutes to vigorously vibrate paint container 4 in order to return all settled paint pigment back into suspension.

Figure 6:
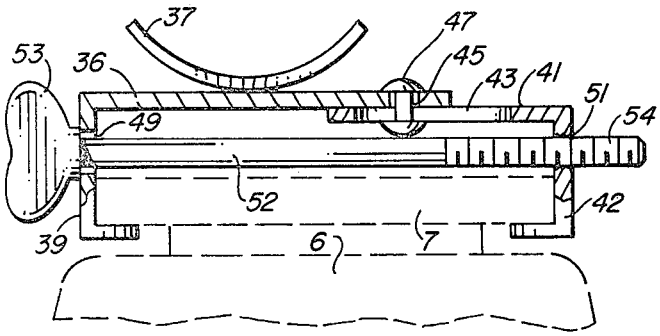
FIG. 6 is a cross-sectional view illustrating an alternative arrangement for clamping the shaking apparatus to the vibrating sanding plate of a hand-held power sander.

In FIG. 6, an alternate securing mechanism is illustrated for releasably securing base 9 of the shaking apparatus to vibrating sanding plate 7. Base 36 again includes a cradle 37 for receiving the paint container, and suitable band clamps (not shown) are also provided. Base 36 includes a lipped edge portion for engaging a first edge of vibrating sanding plate 7. A clamping member 41 is slidingly engaged with base 36 and includes a lipped edge portion 41 for engaging the opposite edge of vibrating sanding plate 7. A slot 43 is provided within clamping member 41, and a hole 45 is formed within base 36 adjacent clamping member 41. A rivet or pin 47 is inserted within slot 43 and hole 45 for slidingly engaging clamping member 41 with base 36.

To facilitate adjustment of the distance between opposing lipped edge portions 39 and 42, a hole 49 is formed within lipped edge portion 39 of base 36, and a threaded hole 51 is formed in lipped edge portion 42 of clamping member 41 opposite hole 49. A bolt 52 having a thumbscrew-type head 53 is inserted through hole 49 and includes a threaded end portion 54 for engaging threaded hole 51. As bolt 52 is turned, lipped edge portion 42 of clamping member 41 is urged toward lipped edged portion 39 of base 36 for securely clamping base 36 onto vibrating sanding plate 7. Holes 45 and 49 are disposed sufficiently far from the inwardly turned flanges of lipped edge portions 39 and 42, respectively, to allow vibrating sanding plate 7 of sander 6 to be completely inserted within the securing mechanism, the shaft of bolt 52 lightly contacting the foam padding typically attached to vibrating sanding plate 7.

The securing mechanisms illustrated in FIGS. 1–5 and in FIG. 6 for releasably securing the shaking apparatus to the vibrating sanding plate enable the shaking apparatus to be utilized in conjunction with virtually all power sanders presently available. However, it will be obvious to those skilled in the art that manufacturers of such power sanders could provide a plurality of threaded holes within the vibrating sanding plate. In this case, a corresponding plurality of holes could be provided within the base of the shaking apparatus. The base of the shaking apparatus could then be releasably secured to the vibrating sanding plate merely by inserting screws within each of the plurality of holes formed within the base and threading the plurality of screws into the corresponding plurality of threaded holes provided in the vibrating sanding plate.

Figure 7:
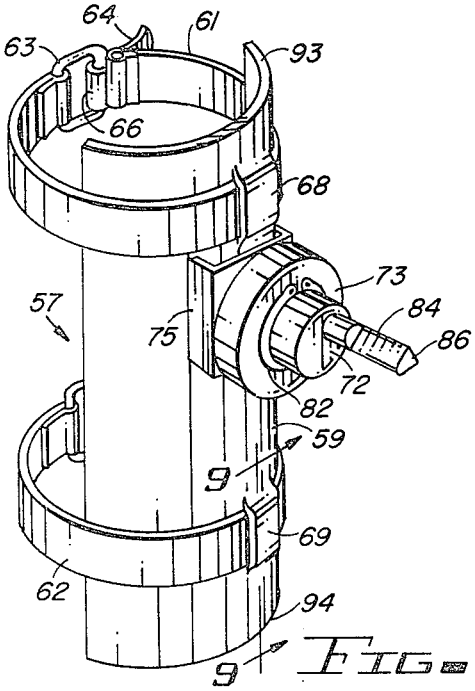
FIG. 7 is a perspective view of a shaking apparatus utilized in conjunction with a drill or other hand-held power tool having a rotatable chuck.
Figure 11:
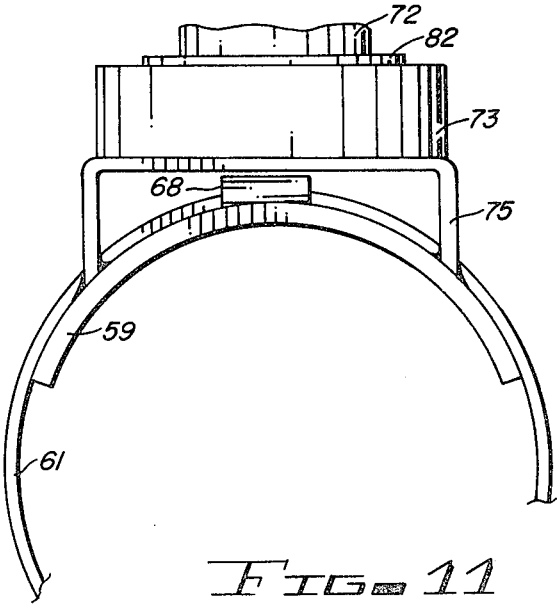
FIG. 11 is a cross-sectional view of the shaking apparatus taken through lines 11—11 as shown in FIG. 8.
Figure 8:
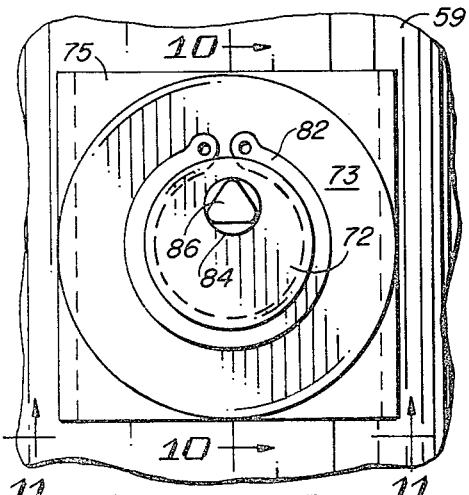
FIG. 8 is an enlarged partial view of the shaking apparatus shown in FIG. 7 and illustrates the means by which the rotational motion of the chuck is converted to oscillatory vibrational movement.

In FIG. 7, a shaking apparatus, designated generally by reference numeral 57, is shown which may be utilized in conjunction with a hand-held power tool having a rotatable chuck such as an electric or pneumatic powered drill. Shaking apparatus 57 includes a base 59 in the form of a cradle or saddle for receiving a paint container to be shaken. A pair of band clamps 61 and 62 are attached to base 59 for removably securing the paint container therein. Each of the band clamps is provided with a buckle 63 at one end of the band and a snap-type clasp 64 pivotally connected to the other end of the band. Clasp 64 includes a hooked end 66 at one end thereof for engaging buckle 63. As the end of clasp 64 opposite hooked end 66 is advanced toward buckle 63, band 61 is tightened for securing the paint container against base 59.

Figure 9:
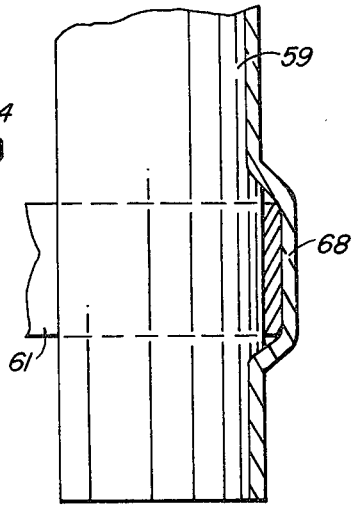
FIG. 9 is a cross-sectional view taken through lines 9—9 as shown in FIG. 7 and illustrates the manner in which a pair of clamps may be secured to a cradle for removably securing a container therein.

As shown best in FIG. 9, band clamps 61 and 62 may be attached to base 59 by punching portion 68 and 69 of base 59 and inserting bands 61 and 62 through the punched out portions 68 and 69, respectively. Those skilled in the art will appreciate that other clamping mechanisms, such as adjustable band clamps 12 and 13 described above with respect to FIG. 1, may be substituted for band clamps 61 and 62.

Referring to FIGS. 7, 8, 10 and 11, a first drive shaft 72 is shown rotatably mounted within bearing housing 73 which is, in turn, secured to base 59 by bracket 75. As shown best in FIG. 10, bearing housing 73 includes a bearing surface 77 for supporting first drive shaft 72. Bearing surface 77 may be a bronze bushing or bearing of the type impregnated with a lubricant and commercially available under the trademark "OILLITE". Alternatively, bearing surface 77 may consist of a series of roller bearings or other low friction members. First drive shaft 72 includes an enlarged rim 79 proximate the rear face thereof for retaining first drive shaft 72 within bearing housing 73. An annular slot 81 is formed within first drive shaft 72 proximate to the front face of bearing housing 73, and a spring steel circular clip 82 is inserted within annular slot 81 for restricting axial movement of first drive shaft 72.

A second drive shaft 84 has a first end secured to the front face of first drive shaft 72. The opposite end of first drive shaft 84 has a triangularly-shaped chamfered portion 86 for engaging the rotatable chuck 88 of a drill or other hand-held power tool. Preferably, second drive shaft 84 has a diameter of approximately one-quarter inch in order to be compatible with the popular, relatively inexpensive hand-held drills having a one-quarter inch drive chuck.

Figure 10:
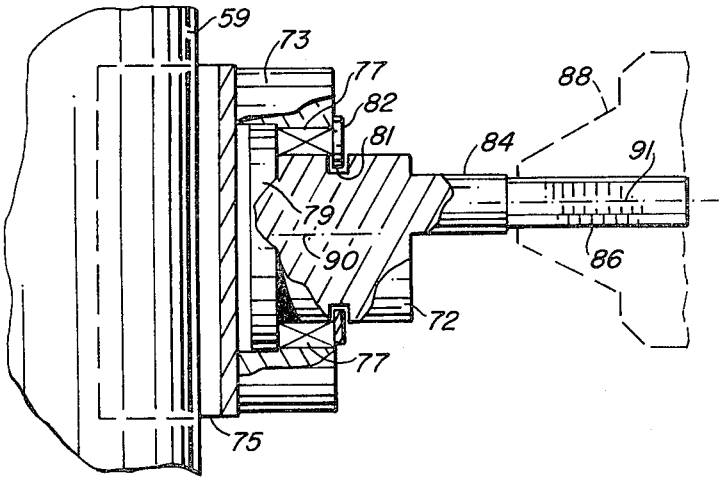
FIG. 10 is a cross-sectional view taken through lines 10—10 as shown in FIG. 8.

As shown in FIG. 10, first drive shaft 72 has an axis of rotation 90, and second drive shaft 84 has an axis of rotation 91 offset from axis 90. Thus, second drive shaft 84 is eccentircally coupled to first drive shaft 74 for causing base 59 to oscillate and vibrate when chuck 88 is rotated. The offset between axis 90 and axis 91 is preferably within the range of one-quarter inch to one-half inch. For power tools which can rotate chuck 88 at a relatively high rate of speed, the offset can be smaller than in the case of power tools which can rotate chuck 88 at a relatively low rate of speed.

In actual use of shaking apparatus 57, a paint container is inserted within base 59, and band clamps 61 and 62 are tightened for securing the container therein. Chamfered portion 86 of second drive shaft 84 is then inserted within rotatable chuck 88, and the chuck is tightened. The user then loosely holds one end of base 59 with one hand and operates the drill with the other hand in order to vigorously vibrate base 59 and the paint container secured thereto. In order that the user may more easily grasp base 59 as it is being vibrated, bracket 75 is located more closely to top edge 93 of base 59 than to the bottom edge 94. Preferably, bracket 75 is centered at a distance from top edge 93 of from one-third to one-fourth the total distance between top edge 93 and bottom edge 94. The user may then grasp base 59 near bottom edge 94 to more easily hold the shaking apparatus as it is being vibrated.

Those skilled in the art will now appreciate that a shaking apparatus has been described which is utilized in conjunction with a hand-held power tool for shaking a container. The shaking apparatus is particularly adapted for shaking aerosol spray paint containers, but may also be used to shake one-quarter pint and one-half pint liquid paint cans, as well as many other types of containers. For containers having a relatively small diameter, such as those containing decorative paint, padding may be inserted around the container to firmly retain it within the saddle. The shaking apparatus may be used in conjunction with hand-held power tools of the type often found around the home for quickly and thoroughly mixing the paint or other matter within such containers. While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. An apparatus utilized in conjunction with a hand-held power drill for shaking a container of spray paint, the hand-held power drill including a rotatable chuck, said apparatus comprising in combination:

a. a semicylindrical cradle for receiving the container of spray paint, said cradle having a longitudinal axis extending between first and second ends thereof, said semicylindrical cradle being adapted to be held loosely in a hand of a user during operation of the hand-held power drill;

b. securing means for removably securing the container of spray paint within said semicylindrical cradle;

c. a bearing secured to said semicylindrical cradle;

d. a first cylindrical driveshaft rotatably mounted within said bearing for movement about a first axis of rotation, said first axis of rotation extending substantially perpendicular to the longitudinal axis of said semicylindrical cradle, said first cylindrical driveshaft having a front face substantially perpendicular to said first axis of rotation at an end of said first cylindrical driveshaft furthest from said semicylindrical cradle;

e. a second generally cylindrical driveshaft having a length substantially commensurate with the length of the rotatable chuck of the hand-held power drill, said second generally cylindrical driveshaft having a diameter smaller than the diameter of said first cylindrical driveshaft and having a first end secured to said front face of said first cylindrical driveshaft and having a second end for being engaged by the rotatable chuck of the hand-held power drill, said second generally cylindrical driveshaft having a second axis of rotation extending substantially perpendicular to said front face of said first cylindrical driveshaft and substantially parallel to said first axis of rotation, said second axis of rotation being offset from said first axis of rotation for allowing a user to vibrate said semicylindrical cradle and the container of spray paint secured thereto by operating the hand-held power drill to rotate said second generally cylindrical driveshaft while holding said semicylindrical cradle loosely in one of the user's hands.

2. An apparatus as recited in claim 1 wherein the offset between the first axis of rotation and the second axis of rotation is in the range of one-quarter inch to one-half inch.

3. An apparatus as recited in claim 1 wherein said bearing is located closer to said first end of said semicylindrical cradle than to said second end for allowing a user to more easily grasp said semicylindrical cradle as it is being vibrated.

4. An apparatus as recited in claim 3 wherein the distance between said bearing surface and said first end is in the range of one-third to one-fourth the distance between said first and second ends.

5. An apparatus as recited in claim 1 further including means for restricting axial movement of said first cylindrical driveshaft within said bearing.

6. An apparatus as recited in claim 5 wherein said securing means comprises a plurality of band clamps coupled to said semicylindrical cradle and spaced apart from one another, each of said band clamps having a buckle secured to a first end thereof and having a snap-type clasp at a second end thereof, said snap-type clasp including a hooked portion for engaging said buckle.

* * * * *